United States Patent [19]

Taylor

[11] Patent Number: 4,877,243

[45] Date of Patent: Oct. 31, 1989

[54] AUTOMATIC BALL PITCHER

[76] Inventor: Jim Taylor, 102 S. College St., Thomasville, Ga. 31792

[21] Appl. No.: 68,896

[22] Filed: Jun. 30, 1987

[51] Int. Cl.[4] ..... A63B 69/40

[52] U.S. Cl. ..... 273/26 R

[58] Field of Search ..... 124/56, 59, 60, 61, 124/62, 65, 70, 71, 72, 73, 74, 41 R, 51 R, 52, 64, 41 C, 50, 79; 272/1 B; 15/3.13, 3.14; 273/26 D, 29 A, 26 B, 72 R; 406/47, 48, 106, 109, 111, 112; 40/409; 56/328 R, 358 TS

[56] References Cited

U.S. PATENT DOCUMENTS

| | | | |
|---|---|---|---|
| 137,119 | 3/1873 | Withers | 446/176 |
| 1,231,251 | 6/1917 | Graham | 273/119 B |
| 1,395,786 | 11/1921 | Anderson | 124/26 |
| 2,869,874 | 1/1959 | Berdner | 273/119 B |
| 2,955,823 | 10/1960 | Chanko | 273/26 D |
| 3,080,859 | 3/1963 | Benkoe | 124/64 |
| 3,236,521 | 2/1966 | Knott | 273/72 R |
| 3,509,584 | 5/1970 | Sable | 272/1 B |
| 3,612,027 | 10/1971 | Makino | 124/16 |
| 3,809,436 | 5/1974 | Ciaffone | 406/48 |
| 3,981,116 | 11/1975 | Valdespino | 15/3.13 |
| 4,207,857 | 6/1980 | Balka, Jr. | 124/56 |
| 4,320,995 | 3/1982 | Tennes et al. | 406/106 |
| 4,538,810 | 9/1985 | Brophy | 273/26 D |
| 4,564,195 | 1/1986 | McClure et al. | 273/29 A |
| 4,575,080 | 3/1986 | Miles | 273/26 R |

*Primary Examiner*—Edward M. Coven
*Assistant Examiner*—T. Brown
*Attorney, Agent, or Firm*—Ostrolenk, Faber, Gerb & Soffen

[57] ABSTRACT

An automatic ball pitcher includes an elongated cylindrical member having a top end and a support means for maintaining said top end at a desired height and position. A ball or spherical object is inserted into the elongated member and dispensed out the top end of said elongated member when a volume of water is introduced into said elongated member. Inlet means are employed for regulating the introduction of the water into said elongated member and outlet means are further employed to release the water from said elongated member once said ball has been dispensed. After the ball is dispensed, it free falls by the force of gravity until it is hit by the swing of a bat, racquet or other device.

16 Claims, 2 Drawing Sheets

FIG. 1
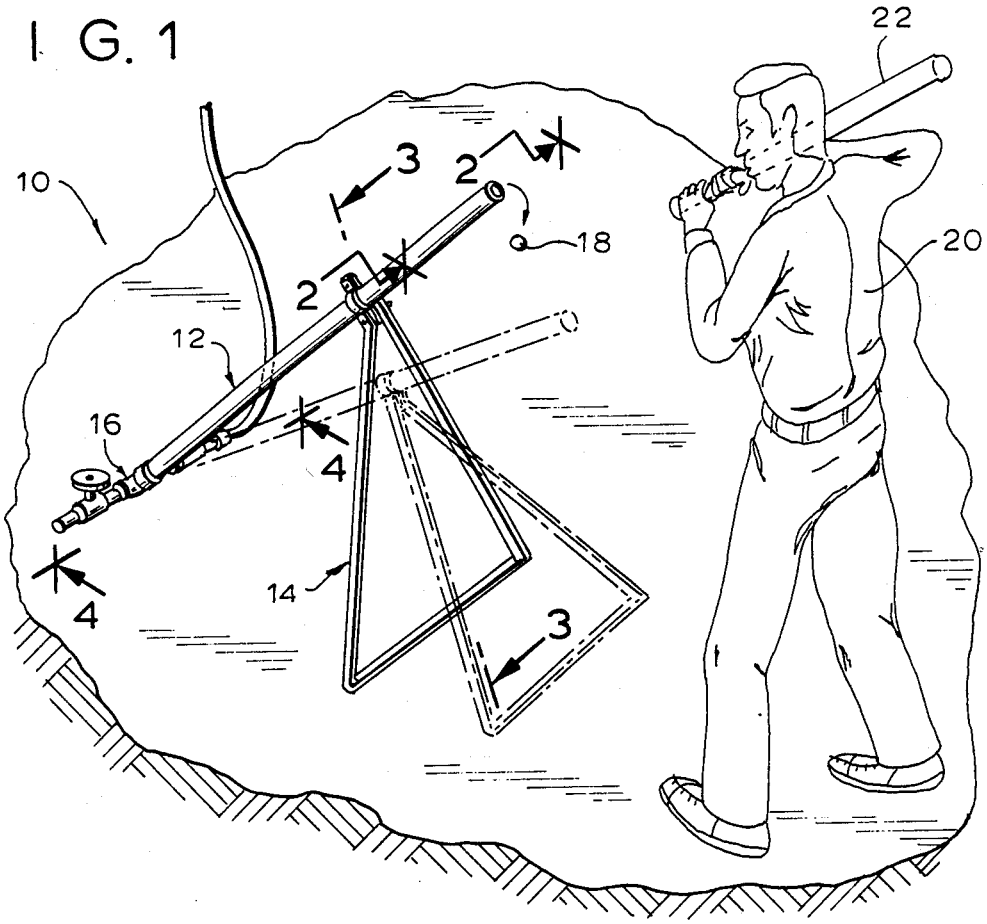
FIG. 2a
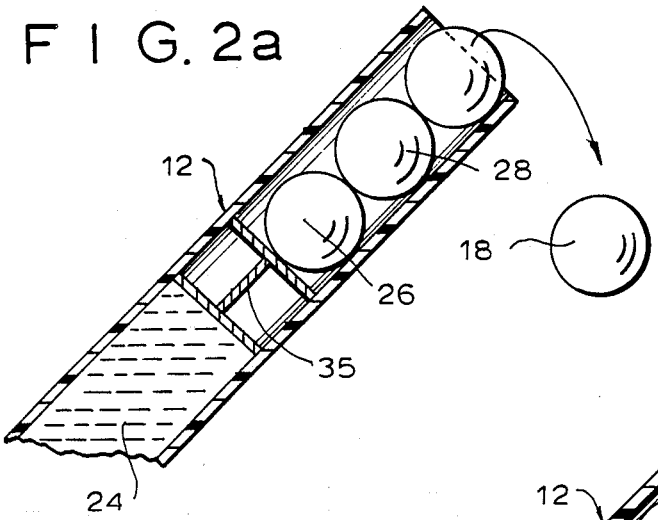
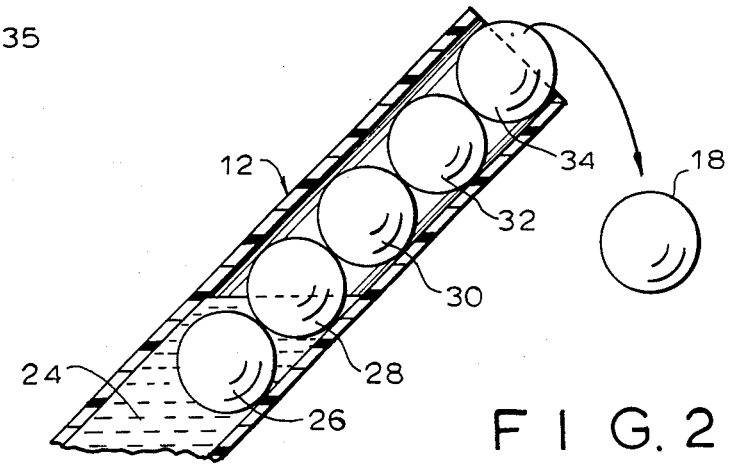
FIG. 2

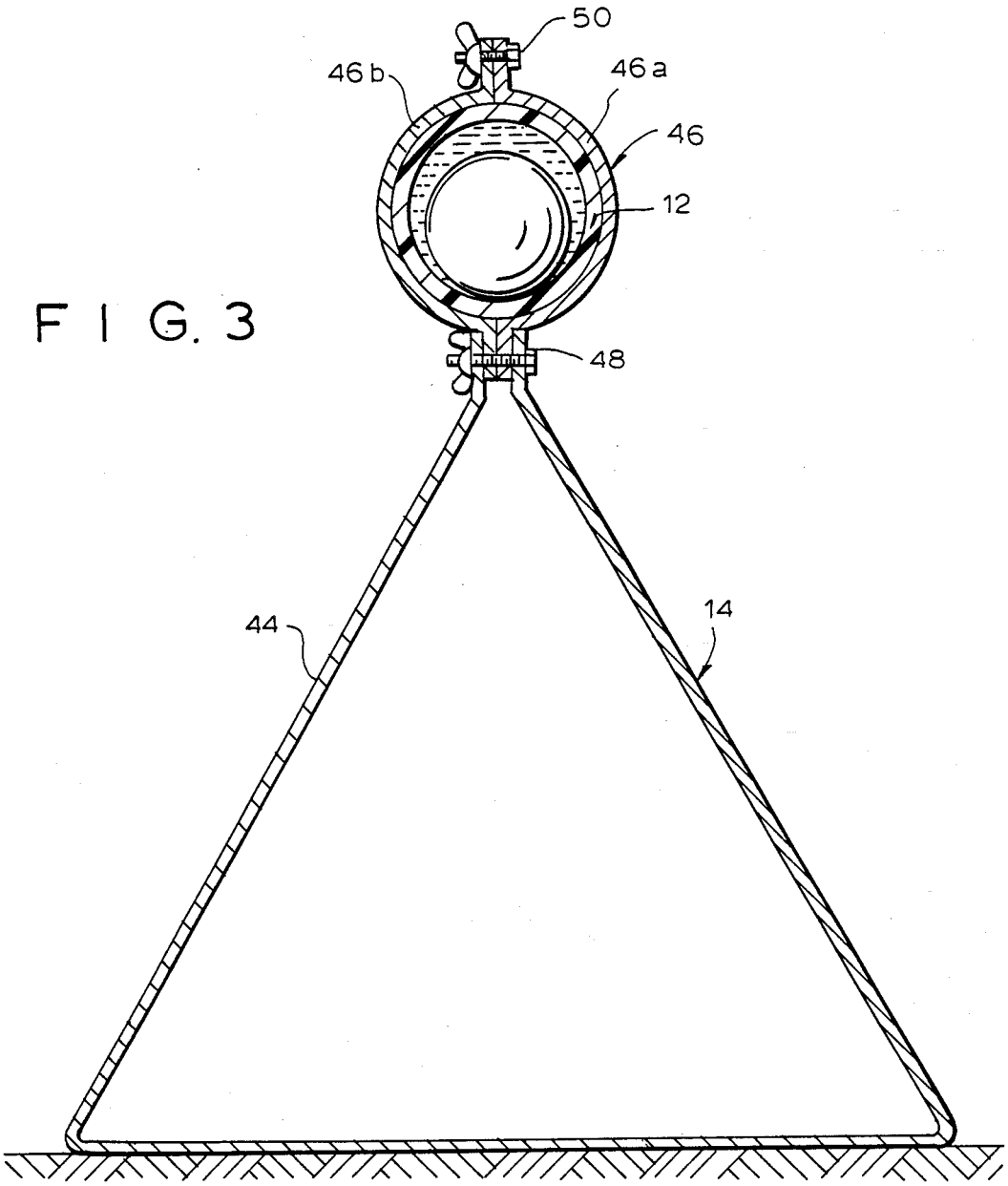
FIG. 3
FIG. 4
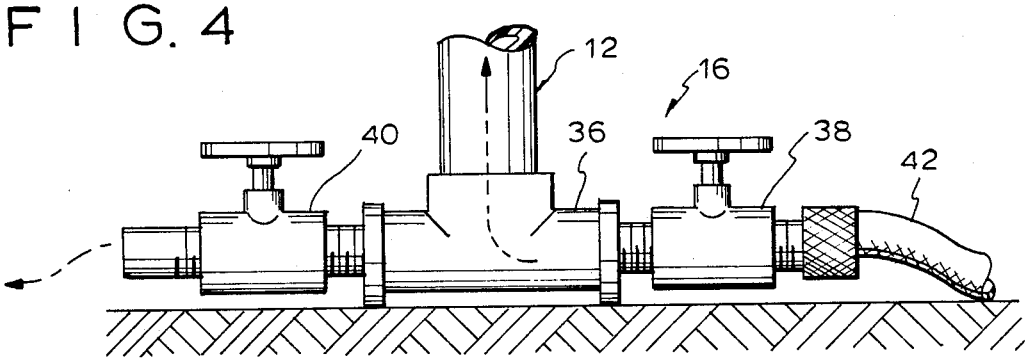

AUTOMATIC BALL PITCHER

BACKGROUND OF THE INVENTION

This invention relates generally to an apparatus for pitching a ball whereby the ball is delivered in free fall by the force of gravity, and more particularly to an economical ball hit game designed for children as well as adults. The ball pitcher of the present invention when attached to an ordinary garden hose provides a water-powered apparatus which automatically pitches balls on a continuous basis. Due to the method of ball delivery, there is no fear of being hurt by a speeding pitch. It also allows a player to play alone, as well as with any number of other players.

Many ball servers or pitchers are known in the prior art. However, these devices are typically expensive, complex and are too sophisticated for use by a child. Further, delivery is usually accomplished by means of compressed air or spring action which hurls the ball at significant velocities which could easily injure a young player. For example, U.S. Pat. No. 4,207,857 of Balka, Jr. issued June 17, 1980 discloses an automatic ball serving device whereby balls are delivered by a firing panel powered by compressed air. U.S. Pat. No. 3,236,521 of Knott issued Feb. 22, 1966 discloses a baseball bat which incorporates either spring loaded or fluid pressure delivery means. The operation of such a device is fairly complicated in that ball delivery is effectuated by acts of the batter and requires a certain amount of coordination which most children do not posses. U.S. Pat. No. 2,955,823 of Chanko issued Oct. 11, 1960 discloses a batting practice device whereby, similar to U.S. Pat. No. 3,236,521, ball delivery is effectuated by acts of the batter which require a certain amount of coordination, detracting from the batter's hitting concentration.

Accordingly, it is an object of the present invention to provide an apparatus for a ball hitting game whereby a ball is delivered in free fall by the force of gravity.

Another object of the present invention is to provide an economical ball hitting game which is safe and easy to use by small children.

Still another object is to provide a simple water powered apparatus that pitches balls commensurate with the height of a player.

SUMMARY OF THE INVENTION

In accomplishing these and other objects in accordance with the present invention an automatic ball pitcher may include an elongated cylindrical member having a top end and support means for maintaining said top end at a variable height and position. A first ball or spherical object is inserted into the elongated member and a second ball is also inserted adjacent the first ball in order to displace the first ball when a volume of water is introduced into said elongated member. Inlet means are employed for regulating the introduction of the wafer into the elongated member and outlet means are further employed to release the fluid from the elongated member when the first and second balls are displaced. Once a ball is displaced from the top end of the elongated member by the introduction of water, it free falls by the force of gravity, falling in the direction of the ground until it is hit by the swing of a bat, raquet or other device.

Further objects, features and advantages of the present invention will be more fully appreciated by reference to the following detailed description when taken in conjunction with the accompanying drawings. It is to be understood that the drawings are designed for the purposes of illustration only and are not intended as a definition of the limits of the invention.

BRIEF DESCRIPTION OF THE DRAWINGS

In the drawings, wherein similar referenced characters denote similar elements throughout the several figures:

FIG. 1 is a perspective view of the pitching apparatus of the present invention while in use;

FIG. 2 is a sectional view of FIG. 1 taken along lines 2—2 of FIG. 1;

FIG. 2*a* is a sectional view illustrating an alternative embodiment of the present invention FIG. 3 is a sectional view of FIG. 1 taken along lines 3—3 of FIG. 1; and FIG. 4 is a sectional view of FIG. 1 taken along the lines 4—4 of FIG. 1.

DETAILED DESCRIPTION OF THE PREFERRED EMBODIMENTS

Generally referring to FIGS. 1, 3 and 4, an automatic pitching apparatus incorporating one embodiment of the present invention is identified generally by the reference numeral 10. Pitching apparatus 10 includes a hollow elongated member 12, a support means 14, a water supply apparatus 16 and a spherical object or ball 18 that has been dispensed from the top end of elongated member 12 by the introduction of water into elongated member 12 by water supply apparatus 16. The water supply apparatus must be connected to a source of water by, for example, a typical garden hose. Once ball 18 has been dispensed, a player 20 will attempt to hit ball 18 by swinging a bat 22, racquet, or other device typically used to a hit a ball.

Ball 18 must be of a size to fit within elongated member 12 and in the perferred embodiment it should be manufactured from a buoyant material, i.e., a material that allows it to float or rise when submerged in water. Typically ball 18 is manufactured of plastic, such as a Wiffle Ball, and measures three inches in diameter even though other types of balls employing other diameters wll certainly fall within the scope of the present invention (such as a tennis ball, hand ball, stick ball, etc.). Of course, member 12 shall have interior dimensions sufficient to accommodate the size of the ball or balls used.

Ball 18 is dispensed from elongated member 12 when water is introduced into the elongated member. As the volume of water in member 12 is increased, ball 18 (being manufactured of buoyant material), will float to the top of elongated member 12 until it is forced out of the top end. Once it is forced out, gravity will force it to fall in the direction of the ground, providing player 20 with a chance to hit it. Any number of balls can be loaded into elongated member 12 and the frequency of displacement can be varied by adjusting the water flow rate into elongated member 12.

In the preferred embodiment elongated member 12 is of a cylindrical configuration and approximately six feet in length which allows it to be loaded with approximately twenty-five balls (not shown) prior to commencing play. Typically, elongated member 12 is formed of polyvinyl chloride (PVC) pipe although it could be manufactured of any other known material from which pipes are currently manufactured, such as copper or any other rigid material that would be in accordance with the present invention. Further, elongated member 12 does not have to be cylindrical in shape. It could have, for example, a rectangular or triangular cross-section limited only by its interior dimensions such as to freely permit passage of the balls used throughout its length.

FIG. 2 shows ball 18 being dispensed from the top end of elongated member 12. Water 24 is shown to be in contact with balls 26 and 28. Since balls 26 and 28 are buoyant, they float and displace balls 30, 32 and 34 throughout the length of elongated member 12 and dispense ball 18 out the top end of elongated member 12 when the volume of water 24 in elongated member 12 is increased.

Ball 26 is shown to be completely submerged in water 24 and ball 28 is shown to be partially submerged. Since these balls are buoyant, it is important to realize that they are submerged under water 24 due to the weight of the other balls contained in elongated member 12. The number of balls submerged in water 24, therefore, would be dependent on the size, weight and number of other balls loaded into elongated member 12. Further, all of the balls loaded in member 12 do not have to be buoyant. The only balls that need to be buoyant are those located at the bottom end of elongated member 12. It will be appreciated by one skilled in the art that the number of buoyant balls required would be dictated by the total number of non-buoyant balls and by their size and weight. Thus one would need to include a sufficient number of buoyant balls to displace the remaining balls throughout the length of elongated member 12 and dispensing them out the top end of elongated member 12 when water is introduced and its volume increased.

Balls 26, 28 and 30 have a surface ornamentation sufficient to differentiate their appearance from the other balls in member 12. Typically this is accomplished by painting them a bright color, such as red. These balls function to warn the user that the supply of balls is used up, or that there are only a limited number of balls left, depending on whether or not the player desires to hit balls 26, 28 and 30. It should be noted that any number of balls can be differentiated and other means could be employed to notify the player that the supply of balls is used up or about to be used up, such as a counter or any other means known to one skilled in the art.

With reference to FIG. 2*a*, if the ball 26 and 28 deteriorate when placed in direct contact with water like, for example a tennis ball, it would be within the scope of the present invention to employ a gasket means 35 between water 24 and the first ball, i.e., ball 26. The gasket mean 35 functions to prevent water from coming in contact with the balls, and displaces the balls throughout the length of elongated member 12 and out its top end. FIG. 2*a* shows gasket means 35 in a piston-type configuration. However, it will be appreciated by those skilled in the art that gasket means 35 can be designed in alternative configurations.

With reference now to FIGS. 1 and 4, water supply apparatus 16 functions to regulate the flow of water into and out of elongated member 12. Water supply apparatus 16 includes a T joint 36, an inlet value 38 and an outlet valve 40. The bottom end of member 12 is supported by and engaged to a T joint 36. The base of T joint 36 may be weighed down to stabilize water supply apparatus 16 by filling it with a dense composition such as conncrete. T joint 36 is connected to inlet valve 38 and outlet valve 40. Inlet valve 38 is connected to a main water supply by hose 42. Inlet valve 38 can be a restriction type valve that is capable of controlling the water flow rate into member 12 and hence the frequency upon which the balls are dispensed out of member 12. It is in accordance with the present invention that hose 42 is to be a regular garden hose although other types of hoses may be used.

When use of the present invention is desired, outlet valve 40 is in a closed position and inlet valve 38 is in an open position. The main water supply is turned on and water is carried by hose 42 through inlet valve 38 and T-joint 36 and into elongated member 12. Elongated member 12 begins to fill with water which then causes balls (which have been loaded into elongated member 12) to be dispensed out of elongated member 12 at a frequency commensurate with the water flow rate. Typically the water flow rate is controlled by adjusting inlet valve 38. Once all of the balls have been dispensed, inlet valve 38 is closed and outlet valve 40 is opened in order to release the volume of water presently contained within elongated member 12. Once the volume of water is released, outlet valve 40 is closed, elongated member 12 is again loaded with balls and the game is once again ready to be played.

Referring now to FIGS. 1 and 3, pitching apparatus 10 can accommodate the height of player 20 by adjusting the top end of elongated member 12 to a desired height and position. This is accomplished by support means 14 which includes a triangular support 44 and a clamp 46 including half-members 46*a* and 46*b*. Half members 46*a* and 46*b* are hingeably connected to triangular support 38 by a screw and wingnut assembly 48. Elongated member 12 is positioned within the inside diameter of half-members 46*a* and 46*b* until elongated member 12 is desirably supported. Half-members 46*a* and 46*b* secure elongated member 12 by frictionally engaging elongated member 12 when screw and wingnut assembly 50 is tightened. The top end of elongated member 12 can be further adjusted by loosening screw and wingnut assembly 48 and positioning triangular support 44 to a desired location and then tightening wingnut assembly 48. The phantom position of FIG. 1 shows one alternative position of apparatus 10, obtained by adjusting support means 14. Typically, the height of the top end of elongated member 12 should be able to be adjusted through a range of 3 to 5 feet. Of course, such range is exemplary of the preferred embodiment only and would depend on the size of player 20, the size of support means 14 and the length of elongated member 12.

As will be readily apparent to those skilled in the art, the invention may be used in other specific forms or for other purposes without departing from its scope or central characteristics. The present embodiment is therefore to be considered as illustrative and not restrictive, the scope of the invention being indicated by the claims rather than by the foregoing description, and all embodiments which come within the range of equivalence of the claims are intended to be embodied.

What is claimed is:

1. An automatic ball pitcher comprising:

a hollow elongated member having a top end and a bottom end;

support means for maintaining the top end at a desired height and position, said support means including means to adjust the top end of said elongated member to a variety of heights and positions;

a plurality of spherical objects adapted to be inserted in said elongated member; and, inlet means for introducing a volume of liquid into said elongated member to cause said spherical objects to float towards and be singularly dispensed out of the top end of said elongated member.

2. The automatic ball pitcher of claim 1 further comprising:

outlet means for draining the liquid from said elongated member after said spherical objects are dispensed.

3. The automatic ball pitcher of claim 2 wherein said inlet means and said outlet means include a T-joint fixed proximate to the bottom end of said elongated member and, in inlet valve and an outlet valve in fluid communication with said elongated member.

4. The automatic ball pitcher of claim 1 wherein said spherical objects are made of plastic material.

5. The automatic ball pitcher of claim 1 wherein said elongated member is cylindrical.

6. The automatic ball pitcher of claim 1 wherein said inlet means is adapted to be connected to a supply of liquid.

7. An automatic ball pitcher comprising:

a hollow elongated member having a top end and a bottom end;

said bottom end connected to a liquid supply apparatus including a first valve to control the inlet of liquid into said elongated member and a second valve to control the outlet of the liquid from said elongated member, said liquid supply apparatus adapted to be removably connected to a supply of liquid;

support means adjustably connected to said elongated member and adapted to be positioned along the length of said elongated member to vary the height of the top end of said elongated member; and a plurality of spherical objects sized to be displaced through the length of said elongated member and dispensed out of said top end of said elongated member when a volume of water is introduced into said elongated member by the liquid supply apparatus.

8. The automatic ball pitcher of claim 7 wherein said spherical objects are made of plastic material.

9. The automatic ball pitcher of claim 7 further comprising:

indicating means for determining when a number of said spherical objects have been dispensed out said top end of said elongated member.

10. The automatic ball pitcher of claim 9 wherein said indicating means includes means differentiating at least one of said spherical objects from the remainder of said spherical objects.

11. The automatic ball pitcher of claim 7 wherein said liquid supply apparatus further comprises:

a T joint fixed proximate to the bottom end of said elongated member joining said first valve said second valve and said elongated member in fluid communication.

12. The automatic ball pitcher of claim 11 wherein said first valve is adapted to be connected to a supply of liquid.

13. The automatic ball pitcher of claim 7 further comprising:

gasket means positioned intermediate said spherical objects and the volume of liquid introduced into said elongated member by said liquid supply apparatus whereby said gasket means is forced in a generally upwards direction through the length of said elongated member by the volume of liquid to move said spherical objects in a generally upward direction through the length of said elongated member to be singularly dispensed out of the top end of said elongated member.

14. An automatic ball pitcher comprising:

a hollow elongated member having a top end and a bottom end;.

support means for maintaining said top end at a desired height and position;

a plurality of spherical objects adapted to be received and retained by said elongated member;

inlet means for introducing a volume of liquid into said elongated member to cause at least some of said spherical objects to float thereby moving said spherical objects in a generally upwards direction through the length of said elongated member to be singularly dispensed out of the top end of said elongated member; and, outlet means to drain the liquid from said elongated member after said spherical objects have been dispensed out of the top end of said elongated member, said inlet means and said outlet means including a T-joint fixed proximate to the bottom end of said elongated member and, an inlet valve and an outlet valve in fluid communication with said elongated member.

15. The automatic ball pitcher of claim 14 wherein said spherical objects are dispensed out of the top end of said elongated member in a downward direction.

16. An automatic baseball pitcher comprising:

a hollow elongated member having a top end and a bottom end;

support means for maintaining said top end at a desired height and position;

a plurality of spherical objects adapted to be inserted into said elongated member;

inlet means for introducing a volume of liquid into said elongated member to cause such spherical objects to float and be singularly dispensed out of the top end of said elongated member; and, outlet means for draining the liquid from said elongated member after said spherical objects are dispensed, said inlet means and said outlet means including a T-joint fixed proximate to said bottom end of said elongated member, an inlet valve and an outlet valve, said T-joint joining said elongated member, said inlet valve and said outlet valve in fluid communication.

* * * * *